US009227420B1

(12) United States Patent
Nakamura

(10) Patent No.: US 9,227,420 B1
(45) Date of Patent: Jan. 5, 2016

(54) INKJET PRINTING APPARATUS

(71) Applicant: RISO KAGAKU CORPORATION, Tokyo (JP)

(72) Inventor: Hiroyuki Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/743,164

(22) Filed: Jun. 18, 2015

(30) Foreign Application Priority Data

Jul. 2, 2014 (JP) ..... 2014-136741

(51) Int. Cl.
*B41J 2/18* (2006.01)
*B41J 2/17* (2006.01)
*B41J 2/175* (2006.01)

(52) U.S. Cl.
CPC *B41J 2/18* (2013.01); *B41J 2/1707* (2013.01); *B41J 2/17596* (2013.01)

(58) Field of Classification Search
None
See application file for complete search history.

(56) References Cited

U.S. PATENT DOCUMENTS

| | | | | |
|---|---|---|---|---|
| 9,016,843 | B2 | 4/2015 | Nishiyama et al. | |
| 9,061,516 | B2 | 6/2015 | Akiyama et al. | |
| 2008/0158307 | A1 * | 7/2008 | Nitta et al. | 347/85 |
| 2010/0194798 | A1 * | 8/2010 | Asami et al. | 347/7 |

FOREIGN PATENT DOCUMENTS

JP 2012-153004 A 8/2012

OTHER PUBLICATIONS

U.S. Appl. No. 14/742,902 to Hiroshi Sugitani et al., filed Jun. 18, 2015.
U.S. Appl. No. 14/851,163 to Hiroshi Sugitani et al., filed Sep. 11, 2015.
U.S. Appl. No. 14/849,883 to Hiroshi Sugitani et al., filed Sep. 10, 2015.
U.S. Appl. No. 14/826,460 to Tomoyuki Akiyama et al., filed Aug. 14, 2015.
U.S. Appl. No. 14/801,069 to Akira Nishiyama et al., filed Jul. 16, 2015.

* cited by examiner

*Primary Examiner* — Shelby Fidler
*Assistant Examiner* — Tracey McMillion
(74) *Attorney, Agent, or Firm* — Greenblum & Bernstein, P.L.C.

(57) ABSTRACT

An inkjet printing apparatus includes a control unit which, in order to reduce a failure of an air pump, when starting ink circulation, executes preparatory processing of feeding ink from the pressurizing tank toward the inkjet head by applying a positive pressure to a pressurizing tank by an air pump in a state in which the pressurizing tank is sealed by a pressurizing-side atmospheric air opening valve and a negative-pressure tank is opened to the atmosphere by a negative-pressure side atmospheric air opening valve; and feeding ink from the negative-pressure tank to the pressurizing tank by the ink pump until the liquid level height of the negative-pressure tank reaches less than a reference height.

4 Claims, 7 Drawing Sheets

FIG. 7

| | | NEGATIVE-PRESSURE TANK LEVEL SENSOR | |
|---|---|---|---|
| | | ON | OFF |
| PRESSURIZING TANK LEVEL SENSOR | ON | INK PUMP: OFF<br>INK SUPPLY VALVE: CLOSE | INK PUMP: OFF<br>INK SUPPLY VALVE: CLOSE |
| | OFF | INK PUMP: ON<br>INK SUPPLY VALVE: CLOSE | INK PUMP: OFF<br>INK SUPPLY VALVE: OPEN |

INKJET PRINTING APPARATUS

BACKGROUND

1. Technical Field

The present invention relates to an ink-circulation type inkjet printing apparatus.

2. Related Art

An ink-circulation type inkjet printing apparatus is known which performs printing by discharging ink from an inkjet head while circulating ink.

As the ink-circulation type inkjet printing apparatus, there is one that includes a pressurizing tank and a negative-pressure tank arranged below the inkjet head, and an air pump for feeding air from the negative-pressure tank to the pressurizing tank (see Patent Literature 1, for example).

In this type of inkjet printing apparatus, a negative pressure and a positive pressure are applied to the negative-pressure tank and the pressurizing tank, respectively, by feeding air from the negative-pressure tank to the pressurizing tank by the air pump when printing is performed. As a result, ink flows from the pressurizing tank toward the inkjet head. The ink not consumed in the inkjet head is recovered into the negative-pressure tank. The ink is fed from the negative-pressure tank to the pressurizing tank by the ink pump. Ink is thus circulated.

In this type of inkjet printing apparatus, since the pressurizing tank and the negative-pressure tank are arranged below the inkjet head, overflow of the ink from a nozzle of the inkjet head during standby can be avoided.

PRIOR ART DOCUMENT

Patent Literature

[Patent Literature 1] Japanese Patent Application Publication No. 2012-153004

SUMMARY

Problems to be Solved by the Invention

During standby in the inkjet printing apparatus as described above, the inkjet head might suction air from the nozzle due to breakage of meniscus of the nozzle caused by vibration. Thereby, the ink in the inkjet head and in an ink path from the pressurizing tank to the negative-pressure tank is replaced by air, and the ink might flow down into the pressurizing tank and the negative-pressure tank. As a result, the pressurizing tank and the negative-pressure tank might be filled with the ink. The vibration breaking the meniscus of the nozzle includes vibration occurring when the inkjet printing apparatus is moved, for example.

If the air pump is driven for ink circulation when the pressurizing tank and the negative-pressure tank are filled with the ink as described above, the ink flows from the negative-pressure tank to the air pump, and there is a concern that the ink enters the air pump and the air pump breaks down.

The present invention has been made in view of the above problem. An object of the present invention is to reduce a failure of the air pump in the ink-circulation type inkjet printing apparatus in which the pressurizing tank and the negative-pressure tank are arranged below the inkjet head and a positive pressure and a negative pressure are applied to the pressurizing tank and the negative-pressure tank, respectively, by the air pump during ink circulation.

Means for Solving the Problem

In order to achieve the above-described object, a first aspect of an inkjet printing apparatus according to the present invention includes:

a printing unit having:

an inkjet head storing ink and discharging ink;

a pressurizing tank arranged below the inkjet head and storing ink to be supplied to the inkjet head;

a negative-pressure tank arranged below the inkjet head and receiving ink not consumed in the inkjet head;

a circulation path for circulating ink among the pressurizing tank, the inkjet head, and the negative-pressure tank; and an ink pump for feeding ink from the negative-pressure tank to the pressurizing tank;

a pressurizing-side atmospheric air opening valve for switching the pressurizing tank between a sealed state and an atmospheric air open state;

a negative-pressure side atmospheric air opening valve for switching the negative-pressure tank between a sealed state and an atmospheric air open state;

an air pump for feeding air from the negative-pressure tank to the pressurizing tank; and a control unit configured to bring the pressurizing tank and the negative-pressure tank into the sealed state, respectively, by the pressurizing-side atmospheric air opening valve and the negative-pressure side atmospheric air opening valve, to feed ink from the pressurizing tank toward the inkjet head by bringing about a state in which a positive pressure is applied to the pressurizing tank and a negative pressure is applied to the negative-pressure tank by the air pump, and to circulate ink along the circulation path by controlling driving of the ink pump in accordance with liquid level heights of the pressurizing tank and the negative-pressure tank, wherein the control unit, when starting ink circulation, executes preparatory processing of feeding ink from the pressurizing tank toward the inkjet head by applying a positive pressure to the pressurizing tank by the air pump in a state in which the pressurizing tank is sealed by the pressurizing-side atmospheric air opening valve and the negative-pressure tank is opened to the atmosphere by the negative-pressure side atmospheric air opening valve; and feeding ink from the negative-pressure tank to the pressurizing tank by the ink pump until the liquid level height of the negative-pressure tank reaches less than a reference height.

A second aspect of the inkjet printing apparatus according to the present invention includes:

a plurality of the printing units; further a pressurizing-side common space portion communicating with the pressurizing tanks of the plurality of printing units; and a negative-pressure side common space portion communicating with the negative-pressure tanks of the plurality of printing units, wherein:

the pressurizing-side atmospheric air opening valve switches the pressurizing tanks of the plurality of printing units between the sealed state and the atmospheric air open state through the pressurizing-side common space portion;

the negative-pressure side atmospheric air opening valve switches the negative-pressure tanks of the plurality of printing units between the sealed state and the atmospheric air open state through the negative-pressure side common space portion; and the air pump feeds air from the negative-pressure tanks to the pressurizing tanks of the plurality of printing units through the pressurizing-side common space portion and the negative-pressure side common space portion.

A third aspect of the inkjet printing apparatus according to the present invention is that:

the control unit executes the preparatory processing when a predetermined preparatory processing execution condition is satisfied and omits the preparatory processing when the preparatory processing execution condition is not satisfied.

BRIEF DESCRIPTION OF DRAWINGS

FIG. 7 is an explanatory view of liquid level maintaining control; and

DETAILED DESCRIPTION

Figure 1:
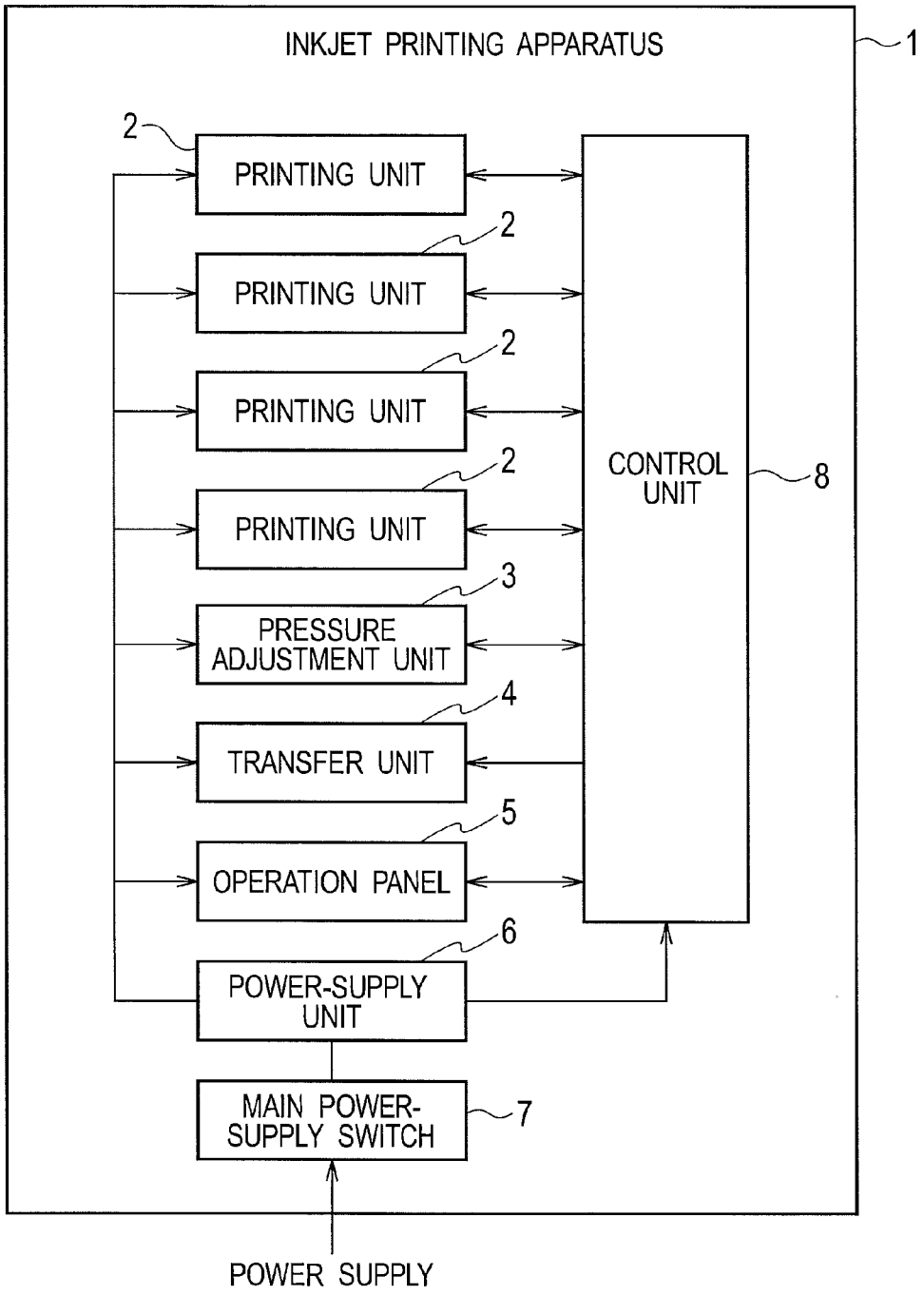
FIG. 1 is a block diagram illustrating a configuration of an inkjet printing apparatus according to an embodiment.

An embodiment of the present invention will be described below with reference to the drawings. The same or equivalent reference numerals are given to the same or equivalent portions and constituent elements throughout the drawings. However, it should be noted that the drawings are schematic and different from real ones. Moreover, it is needless to say that portions with different relation between dimensions and with different ratios are included even among the drawings.

The embodiment illustrated below exemplifies an apparatus and the like for embodying a technical idea of the present invention, and the technical idea of the present invention does not limit a material, a shape, a structure, arrangement and the like of each component to those described below. The technical idea of the present invention can be changed in various ways in claims.

Figure 2:
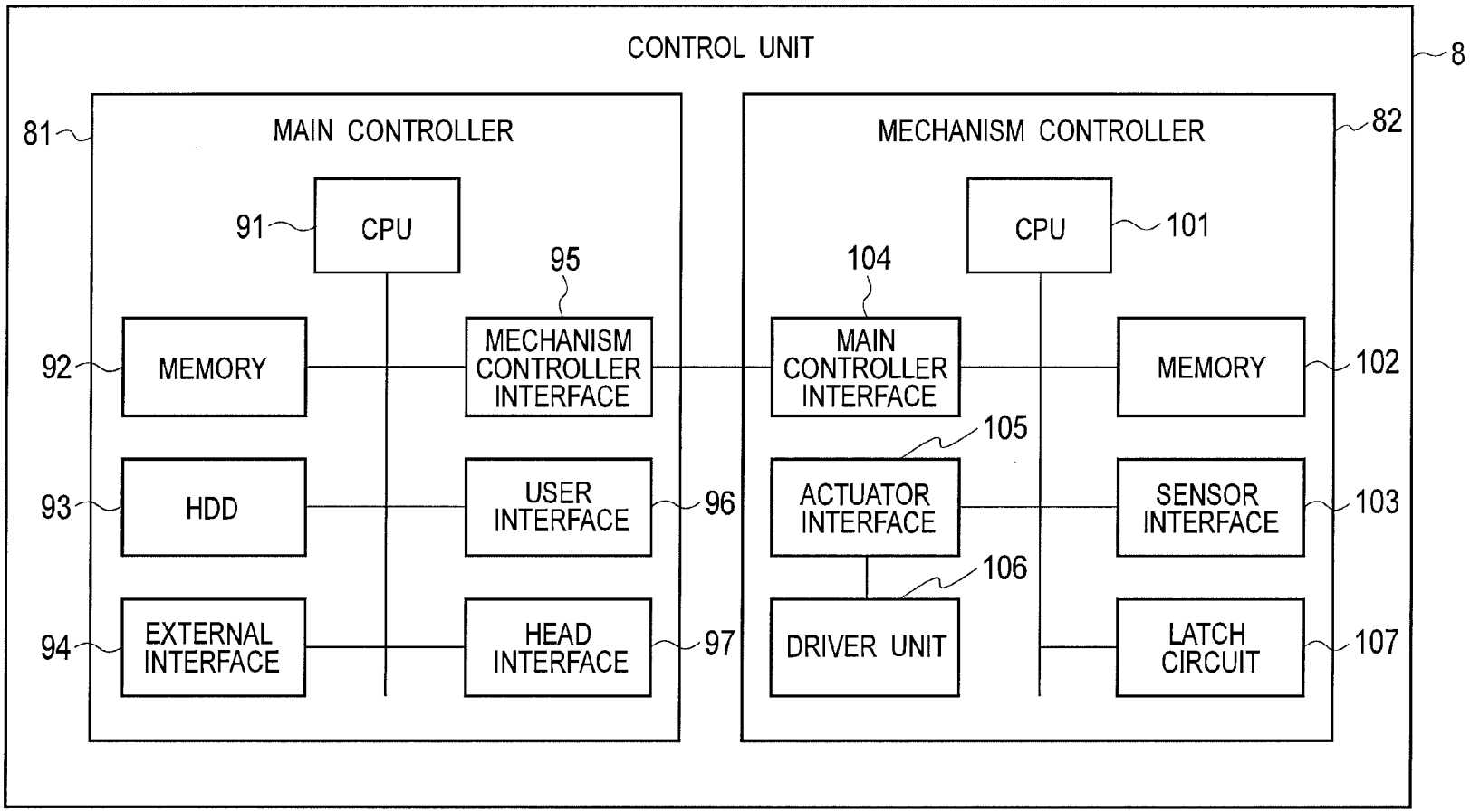
FIG. 2 is a block diagram illustrating a configuration of a control unit of the inkjet printing apparatus illustrated in FIG. 1.
Figure 3:
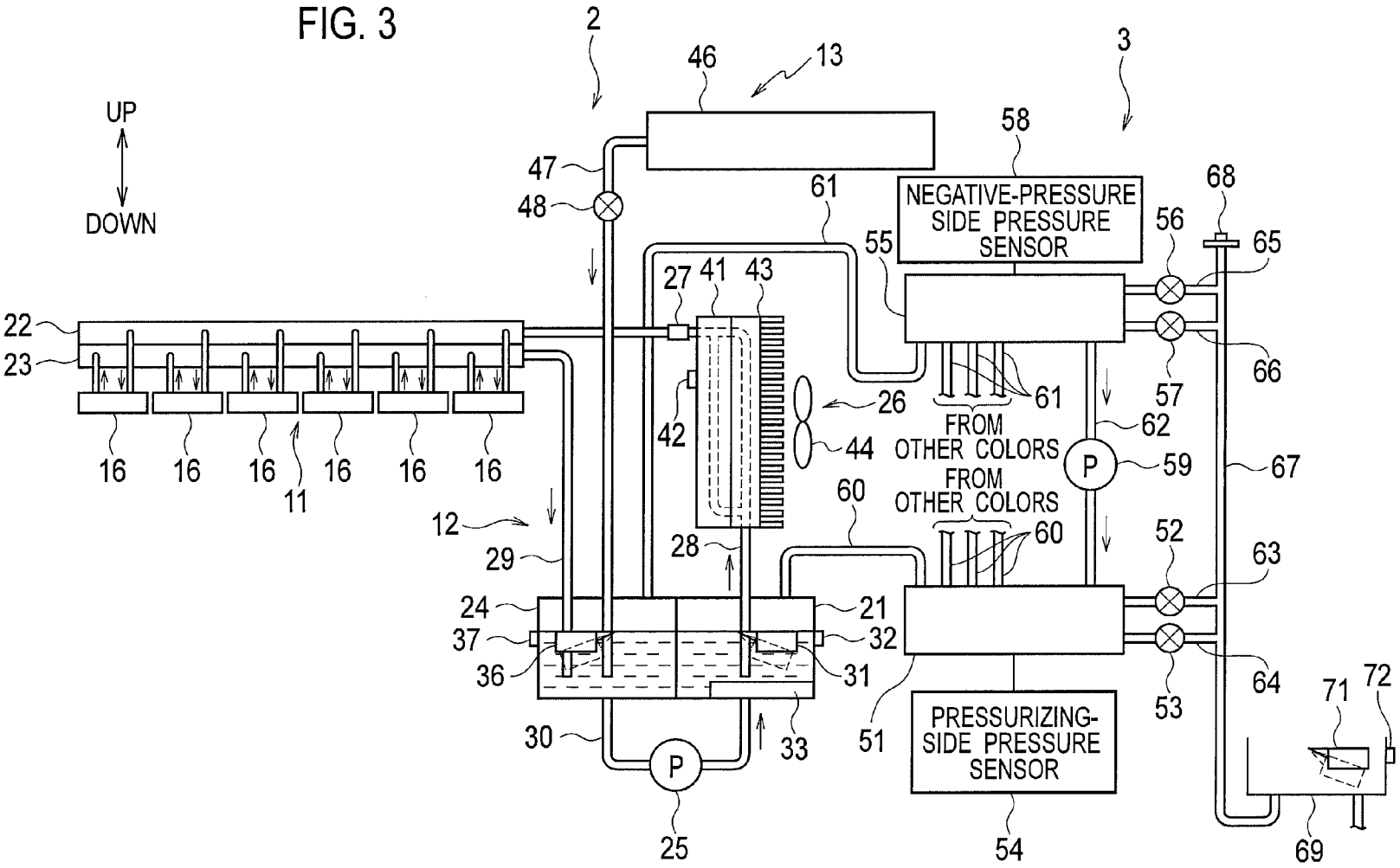
FIG. 3 is an outline configuration view of a printing unit and a pressure adjustment unit of the inkjet printing apparatus illustrated in FIG. 1.

FIG. 1 is a block diagram illustrating a configuration of an inkjet printing apparatus according to an embodiment of the present invention. FIG. 2 is a block diagram illustrating a configuration of a control unit of the inkjet printing apparatus illustrated in FIG. 1. FIG. 3 is an outline configuration view of a printing unit and a pressure adjustment unit of the inkjet printing apparatus illustrated in FIG. 1. An up-and-down direction in the description below refers to a vertical direction, and up and down in FIG. 3 is assumed to be an up-and-down direction.

As illustrated in FIG. 1, an inkjet printing apparatus 1 according to this embodiment includes four printing units 2, a pressure adjustment unit 3, a transfer unit 4, an operation panel 5, a power-supply unit 6, a main power-supply switch 7, and a control unit 8.

The printing unit 2 discharges ink to a sheet transferred by the transfer unit 4 while circulating ink so as to print an image. The four printing units 2 discharge colors different from each other (black (K), cyan (C), magenta (M), and yellow (Y), for example). The four printing units 2 have the similar configuration except that the colors of the discharged ink are different.

As illustrated in FIG. 3, the printing unit 2 includes an inkjet head 11, an ink circulation unit 12, and an ink supply unit 13.

The inkjet head 11 discharges ink supplied by the ink circulation unit 12. The inkjet head 11 is composed of a plurality of head modules 16.

The head module 16 is of a piezo type. The head module 16 has an ink chamber storing ink and a plurality of nozzles discharging the ink (none of them is shown). A piezo element (not shown) is arranged in the ink chamber. The ink is discharged from the nozzle by driving of the piezo element.

The ink circulation unit 12 supplies the ink to the inkjet head 11 while circulating the ink. The ink circulation unit 12 includes a pressurizing tank 21, an ink distributor 22, an ink collector 23, a negative-pressure tank 24, an ink pump 25, an ink temperature adjustment unit 26, an ink temperature sensor 27, and pipelines 28 to 30.

The pressurizing tank 21 stores ink to be supplied to the inkjet head 11. The ink in the pressurizing tank 21 is supplied to the inkjet head 11 through the pipeline 28 and the ink distributor 22. An air layer is formed on an ink level in the pressurizing tank 21. The pressurizing tank 21 communicates with a pressurizing common air chamber 51 which will be described later through a pipeline 60 which will be described later. The pressurizing tank 21 is arranged at a position lower than (below) the inkjet head 11.

The pressurizing tank 21 has such a capacity that, even if meniscus of the nozzle of the inkjet head 11 is broken by vibration and the ink inside the ink distributor 22 and the pipeline 28 flows down into the pressurizing tank 21, it can be received. However, if the pressurizing tank 21 is too large, size increase of the apparatus is incurred. Thus, the pressurizing tank 21 has a capacity of such a degree that is fully filled when all the ink in the ink distributor 22 and the pipeline 28 flows down into the pressurizing tank 21.

In the pressurizing tank 21, a float member 31, a pressurizing-tank level sensor 32, and an ink filter 33 are provided.

The float member 31 has one end side pivotally supported by a support shaft (not shown) in the pressurizing tank 21 so that it rotationally moves in accordance with the liquid level height until the liquid level height of the ink in the pressurizing tank 21 reaches a reference height. A magnet (not shown) is provided on the other end of the float member 31.

The pressurizing-tank level sensor 32 is to detect whether or not the ink level height in the pressurizing tank 21 has reached the reference height. The reference height is at a position below an upper end of the pressurizing tank 21 by a predetermined distance. The pressurizing-tank level sensor 32 is made of a magnetic sensor and detects the magnet of the float member 31 when the liquid level height reaches the reference height. The pressurizing-tank level sensor 32 outputs a signal indicating "ON" when the magnet of the float member 31 is detected, that is, when the liquid level height in the pressurizing tank 21 is at the reference height or more. The pressurizing-tank level sensor 32 outputs a signal indicating "OFF" when the magnet of the float member 31 is not detected, that is, when the liquid level height in the pressurizing tank 21 is less than the reference height.

The ink filter 33 removes rubbish or the like in the ink.

The ink distributor 22 distributes the ink supplied from the pressurizing tank 21 through the pipeline 28 to each of the head modules 16 of the inkjet head 11.

The ink collector 23 collects the ink not consumed in the inkjet head 11 from each of the head modules 16. The ink collected by the ink collector 23 flows into the negative-pressure tank 24 through a pipeline 29.

The negative-pressure tank 24 receives the ink not consumed in the inkjet head 11 from the ink collector 23 and stores it. Moreover, the negative-pressure tank 24 stores ink supplied from an ink cartridge 46 in the ink supply unit 13 which will be described later. An air layer is formed on the ink level in the negative-pressure tank 24. The negative-pressure tank 24 communicates with a negative-pressure common air chamber 55 which will be described later through a pipeline 61 which will be described later. The negative-pressure tank 24 is arranged at the same height as the pressurizing tank 21.

The negative-pressure tank 24 has such a capacity that, even if meniscus of the nozzle of the inkjet head 11 is broken by vibration and ink inside the inkjet head 11, the ink collector 23, and the pipeline 29 flows down into the negative-pressure tank 24, it can be received. However, if the negative-pressure tank 24 is too large, size increase of the apparatus is incurred. Thus, the negative-pressure tank 24 has a capacity of such a degree that is fully filled when all the ink in the inkjet head 11, the ink collector 23, and the pipeline 29 flows down into the negative-pressure tank 24.

In the negative-pressure tank 24, a float member 36 and a negative-pressure tank level sensor 37 are provided.

The float member 36 and the negative-pressure tank level sensor 37 are similar to the float member 31 and the pressurizing-tank level sensor 32 of the pressurizing tank 21, respectively. The negative-pressure tank level sensor 37 outputs a signal indicating "ON" when the magnet of the float member 36 is detected, that is, when the liquid level height in the negative-pressure tank 24 is at the reference height or more. The negative-pressure tank level sensor 37 outputs a signal indicating "OFF" when the magnet of the float member 36 is not detected, that is, when the liquid level height in the negative-pressure tank 24 is less than the reference height. The reference height is at a position below an upper end of the negative-pressure tank 24 by a predetermined distance.

The ink pump 25 feeds ink from the negative-pressure tank 24 to the pressurizing tank 21. The ink pump 25 is provided in the middle of a pipeline 30.

The ink temperature adjustment unit 26 adjusts a temperature of ink in the ink circulation unit 12. The ink temperature adjustment unit 26 is provided in the middle of the pipeline 28. The ink temperature adjustment unit 26 includes a heater 41, a heater temperature sensor 42, a heat sink 43, and a cooling fan 44.

The heater 41 heats the ink in the pipeline 28. The heater temperature sensor 42 detects a temperature of the heater 41. The heat sink 43 cools the ink in the pipeline 28. The cooling fan 44 feeds cooling air to the heat sink 43.

The ink temperature sensor 27 detects a temperature of the ink in the ink circulation unit 12. The ink temperature sensor 27 is provided in the middle of the pipeline 28.

The pipeline 28 connects the pressurizing tank 21 and the ink distributor 22 to each other. A part of the pipeline 28 branches to a portion via the heater 41 and a portion via the heat sink 43. The ink flows through the pipeline 28 from the pressurizing tank 21 toward the ink distributor 22. The pipeline 29 connects the ink collector 23 and the negative-pressure tank 24. The ink flows through the pipeline 29 from the ink collector 23 toward the negative-pressure tank 24. The pipeline 30 connects the negative-pressure tank 24 and the pressurizing tank 21. The ink flows through the pipeline 30 from the negative-pressure tank 24 toward the pressurizing tank 21. A circulation path for circulating the ink is constituted among the pressurizing tank 21, the inkjet head 11, and the negative-pressure tank 24 by the pipelines 28 to 30, the ink distributor 22, and the ink collector 23.

The ink supply unit 13 supplies the ink to the ink circulation unit 12. The ink supply unit 13 includes the ink cartridge 46, a pipeline 47, and an ink supply valve 48.

The ink cartridge 46 accommodates ink used for printing in the printing unit 2. The ink in the ink cartridge 46 is supplied to the negative-pressure tank 24 through the pipeline 47.

The pipeline 47 connects the ink cartridge 46 and the negative-pressure tank 24 to each other. The ink flows through the pipeline 47 from the ink cartridge 46 toward the negative-pressure tank 24.

The ink supply valve 48 opens/closes an ink channel in the pipeline 47. When the ink is supplied from the ink cartridge 46 to the negative-pressure tank 24, the ink supply valve 48 is opened.

The pressure adjustment unit 3 adjusts pressures of the pressurizing tank 21 and the negative-pressure tank 24 of each printing unit 2. The pressure adjustment unit includes the pressurizing common air chamber 51 (corresponding to a pressurizing-side common space portion in claims), a pressurizing-side pressure adjustment valve 52, a pressurizing-side atmospheric air opening valve 53, a pressurizing-side pressure sensor 54, a negative-pressure common air chamber 55 (corresponding to a negative-pressure side common space portion in claims), the negative-pressure side pressure adjustment valve 56, a negative-pressure side atmospheric air opening valve 57, a negative-pressure side pressure sensor 58, an air pump 59, the four pipelines 60, the four pipelines 61, pipelines 62 to 67, an air filter 68, and an overflow pan 69.

The pressurizing common air chamber 51 is an air chamber for equalizing the pressure of the pressurizing tank 21 of each of the printing units 2. The pressurizing common air chamber 51 communicates with the air layer of the pressurizing tank 21 of each of the four printing units 2 through the four pipelines 60. As a result, the pressurizing tank 21 of each of the printing units 2 is made to communicate with each other through the pressurizing common air chamber 51 and the pipelines 60.

The pressurizing-side pressure adjustment valve 52 opens/closes an air channel in the pipeline 63 in order to adjust the pressure of the pressurizing tank 21 of each of the printing units 2 through the pressurizing common air chamber 51. The pressurizing-side pressure adjustment valve 52 is provided in the middle of the pipeline 63.

The pressurizing-side atmospheric air opening valve 53 opens/closes an air channel in the pipeline 64 in order to switch the pressurizing tank 21 of each of the printing units 2 between a sealed state (shut-off state from the atmosphere) and an atmospheric air open state (state open to the atmosphere) through the pressurizing common air chamber 51. The pressurizing-side atmospheric air opening valve 53 is provided in the middle of the pipeline 64.

The pressurizing-side pressure sensor 54 detects a pressure in the pressurizing common air chamber 51 (pressurizing-side pressure). Here, the pressure in the pressurizing common air chamber 51 is equal to a pressure in the pressurizing tank 21 of each of the printing units 2. That is because the pressurizing common air chamber 51 and the air layer of the pressurizing tank 21 of each of the printing units 2 are made to communicate with each other.

The negative-pressure common air chamber 55 is an air chamber for equalizing the pressure of the negative-pressure tank 24 of each of the printing units 2. The negative-pressure common air chamber 55 is made to communicate with the air layer of the negative-pressure tank 24 of each of the four printing units 2 through the four pipelines 61. As a result, the negative-pressure tanks 24 of the printing units 2 are made to communicate with each other through the negative-pressure common air chamber 55 and the pipeline 61.

The negative-pressure side pressure adjustment valve 56 opens/closes an air channel in the pipeline 65 in order to adjust the pressure of the negative-pressure tank 24 of each of the printing units 2 through the negative-pressure common air chamber 55. The negative-pressure side pressure adjustment valve 56 is provided in the middle of the pipeline 65.

The negative-pressure side atmospheric air opening valve 57 opens/closes an air channel in the pipeline 66 in order to switch the negative-pressure tank 24 of each of the printing units 2 between the sealed state and the atmospheric air open state through the negative-pressure common air chamber 55. The negative-pressure side atmospheric air opening valve 57 is provided in the middle of the pipeline 66.

The negative-pressure side pressure sensor 58 detects a pressure in the negative-pressure common air chamber 55 (negative-pressure side pressure). Here, the pressure in the negative-pressure common air chamber 55 is equal to a pressure in the negative-pressure tank 24 of each of the printing units 2. That is because the negative-pressure common air chamber 55 and the air layer of the negative-pressure tank 24 of each of the printing units 2 are made to communicate with each other.

The air pump 59 feeds air from the negative-pressure tank 24 of each of the printing units 2 to the pressurizing tank 21 through the pressurizing common air chamber 51 and the negative-pressure common air chamber 55. The air pump 59 is provided in the middle of the pipeline 62.

The four pipelines 60 connect the pressurizing common air chamber 51 and the pressurizing tanks 21 of the four printing units 2. The pipeline 60 has one end connected to the pressurizing common air chamber 51 and the other end connected to the air layer of the pressurizing tank 21.

The four pipelines 61 connect the negative-pressure common air chamber 55 and the negative-pressure tanks 24 of the four printing units 2. The pipeline 60 has one end connected to the negative-pressure common air chamber 55 and the other end connected to the air layer of the negative-pressure tank 24.

The pipeline 62 forms a channel of air fed by the air pump 59 from the negative-pressure common air chamber 55 to the pressurizing common air chamber 51. The pipeline 62 has its one end connected to the negative-pressure common air chamber 55 and the other end connected to the pressurizing common air chamber 51.

The pipelines 63 and 64 have their respective one ends connected to the pressurizing common air chamber 51 and the other ends connected to the pipeline 67. The pipelines 65 and 66 have their respective one ends connected to the negative-pressure common air chamber 55 and the other ends connected to the pipeline 67. The pipeline 67 has one end (upper end) communicating with the atmospheric air through the air filter 68 and the other end connected to the overflow pan 69.

The air filter 68 is provided on an upper end of the pipeline 67 and prevents entry of rubbish or the like in the outside air.

Regarding the overflow pan 69, when ink overflows from the pressurizing tank 21 and the negative-pressure tank 24 due to abnormality of the ink supply valve 48, for example, and the ink also overflows from the pressurizing common air chamber 51 and the negative-pressure common air chamber 55, the overflow pan 69 receives the ink.

In the overflow pan 69, a float member 71 and an overflow level sensor 72 are provided. The float member 71 and the overflow level sensor 72 are similar to the float member 31 and the pressurizing tank level sensor 32 of the pressurizing tank 21, respectively.

The overflow pan 69 is connected to a waste liquid tank (not shown) and discharges ink to the waste liquid tank when the overflow level sensor 72 is turned on.

The transfer unit 4 takes out a sheet from a paper feed tray (not shown) and transfers the sheet along a transfer path. The transfer unit 4 has a roller for transferring sheets, a motor for driving the roller (none of them is shown) or the like.

The operation panel 5 displays various input screens or the like and also receives an input operation by a user. The operation panel 5 includes an input portion having various operation keys, a touch panel and the like and a display portion having a liquid crystal display panel or the like (none of them is shown). On the input portion, a sub power supply key (not shown) for switching on/off of a power supply (sub power supply) is provided.

The power supply unit 6 supplies power supplied through the main-power supply switch 7 to each portion of the inkjet printing apparatus 1.

The main power-supply switch 7 is a switch for switching on/off of the main power supply of the inkjet printing apparatus 1. A commercial power supply is connected to the main power-supply switch 7.

The control unit 8 controls operations of the entire inkjet printing apparatus 1. As illustrated in FIG. 2, the control unit 8 includes a main controller 81 and a mechanism controller 82.

The main controller 81 governs control of the entire inkjet printing apparatus 1. The main controller 81 includes a CPU (Central Processing Unit) 91, a memory 92, an HDD (Hard Disk Drive) 93, an external interface 94, a mechanism controller interface 95, a user interface 96, and a head interface 97.

The CPU 91 executes calculation processing. The memory 92 is used as a work area of the CPU 91 for temporary storage of data or calculation. The HDD 93 stores various programs and the like.

The external interface 94 conducts transmission and reception of data to and from external devices via a network. The mechanism controller interface 95 connects the mechanism controller 82 to the main controller 81. The user interface 96 connects the operation panel 5 to the main controller 81. The head interface 97 connects the inkjet head 11 to the main controller 81.

The mechanism controller 82 executes control of ink circulation and ink supply in the printing unit 2, control of pressure adjustment by the pressure adjustment unit 3, and control of sheet transfer by the transfer unit 4. The mechanism controller 82 includes a CPU 101, a memory 102, a sensor interface 103, a main controller interface 104, an actuator interface 105, a driver unit 106, and a latch circuit 107.

The CPU 101 executes calculation processing. The memory 102 is used as a work area of the CPU 101 for temporary storage of data or calculation.

The sensor interface 103 connects various sensors such as the pressurizing tank level sensor 32, the negative-pressure tank level sensor 37 and the like to the mechanism controller 82. The main controller interface 104 connects the mechanism controller 82 to the main controller 81. The actuator interface 105 transmits a control signal to the driver unit 106.

The driver unit 106 has various drivers for driving each of motors of the ink pump 25, the air pump 59, the transfer unit 4 and the like.

The latch circuit 107 holds latch set when the power supply (sub power supply) is turned on for the first time after the main power supply is turned on from off until the main power supply is turned off.

The mechanism controller 82 executes printing processing by a normal circulation operation or the printing processing by a circulation operation with preparatory processing during printing. Specifically, the mechanism controller 82 executes the printing processing by the normal circulation operation when the main power supply has not been shut off after the point of time when the power supply (sub power supply) is turned off the previous time. If the main power supply has been shut off after the point of time of the previous power-off, the mechanism controller 82 executes the printing processing by the circulation operation with preparatory processing.

The normal circulation operation is an ink circulation operation started without executing the preparatory processing which will be described later. The ink circulation operation is an operation for circulating the ink along the circulation path by bringing about a state in which the positive pressure is applied to the pressurizing tank 21 and the negative pressure is applied to the negative-pressure tank 24 by the air pump 59 so as to feed the ink from the pressurizing tank 21 toward the inkjet head 11 and by controlling driving of the ink pump 25 in accordance with the liquid level heights of the pressurizing tank 21 and the negative-pressure tank 24.

The circulation operation with preparatory processing performs the preparatory processing at start of the ink circulation. The preparatory processing is processing of feeding the ink from the pressurizing tank 21 toward the inkjet head 11 by applying the positive pressure to the pressurizing tank 21 by the air pump 59 in a state in which the negative-pressure tank 24 is opened to the atmospheric air, and feeding the ink from the negative-pressure tank 24 to the pressurizing tank 21 by the ink pump 25 until the liquid level height of the negative-pressure tank 24 becomes less than a reference height. After the preparatory processing, the process proceeds to the above-described ink circulation operation.

Subsequently, an operation at on/off operation of the power supply (sub power supply) and the main power supply of the inkjet printing apparatus 1 will be described by referring to FIG. 4.

When the main power supply is off, power is not supplied to each portion of the inkjet printing apparatus 1. When the main power supply is turned on from off by an operation to the main power-supply switch 7, power is supplied to the power-supply unit 6. Then, the power-supply unit 6 supplies power only to the operation panel 5 and the latch circuit 107 of the mechanism controller 82 as a standby power supply.

When the power supply (sub power supply) is turned on from off by the operation to the operation panel 5 in the state in which the main power supply is on, the power-supply unit 6 supplies power to each portion, and the inkjet printing apparatus 1 enters a state of power-on.

When the power supply is turned on from off, immediately after that, the CPU 101 of the mechanism controller 82 reads a latch of the latch circuit 107. As illustrated in FIG. 4, when the power supply (sub power supply) is turned on for the first time after the main power supply is turned on, the latch is not held in the latch circuit 107.

After predetermined time has elapsed since the latch is read, the CPU 101 sets a latch in the latch circuit 107. As a result, the latch circuit 107 is brought into a state holding the latch. After that, even if the power supply (sub power supply) is turned off, the latch circuit 107 holds the latch by the standby power supply as long as the main power supply is on.

Figure 4:
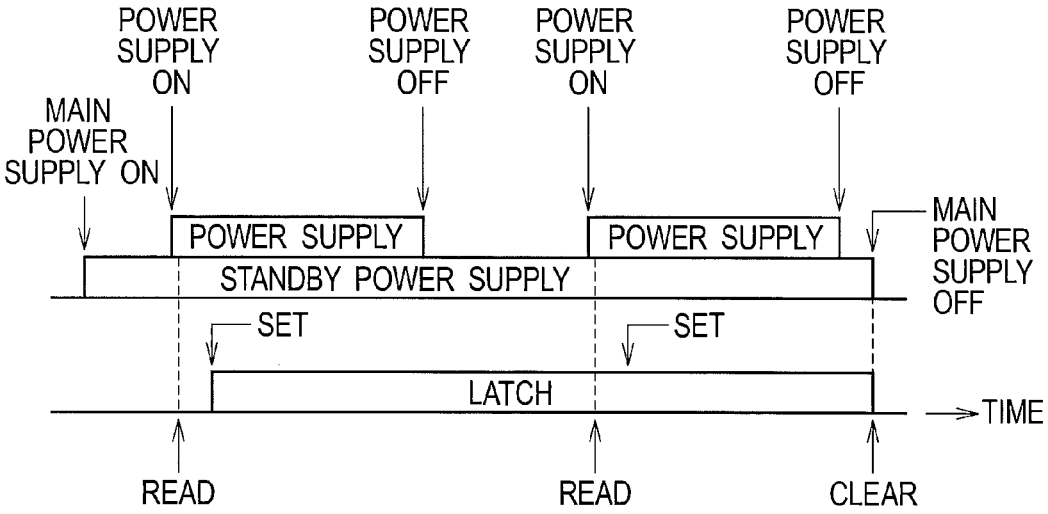
FIG. 4 is an explanatory view of an operation in an on/off operation of a power supply (sub power supply) and a main power supply of the inkjet printing apparatus illustrated in FIG. 1.

Therefore, if the main power supply has not been turned off from the previous power-off when the power supply (sub power supply) is turned on, as illustrated in FIG. 4, the latch circuit 107 is in the state holding the latch when the CPU 101 reads the latch of the latch circuit 107. Even if the latch is held when the latch circuit 107 is read, the CPU 101 executes processing of setting the latch in the latch circuit 107 after predetermined time of read has elapsed, but the state in which the latch circuit 107 holds the latch is not changed.

When the main power supply is turned off from on, the power-supply unit 6 shuts off power to each portion of the inkjet printing apparatus 1. As a result, the latch of the latch circuit 107 is cleared.

By means of the operation as above, if the main power supply has been shut off after the previous power-off, the latch is not held in the latch circuit 107 at the current power-on. On the other hand, if the main power supply has not been shut off after the previous power-off, the latch is held in the latch circuit 107 at the current power-on.

Subsequently, an operation in printing of the inkjet printing apparatus 1 will be described.

Figure 5:
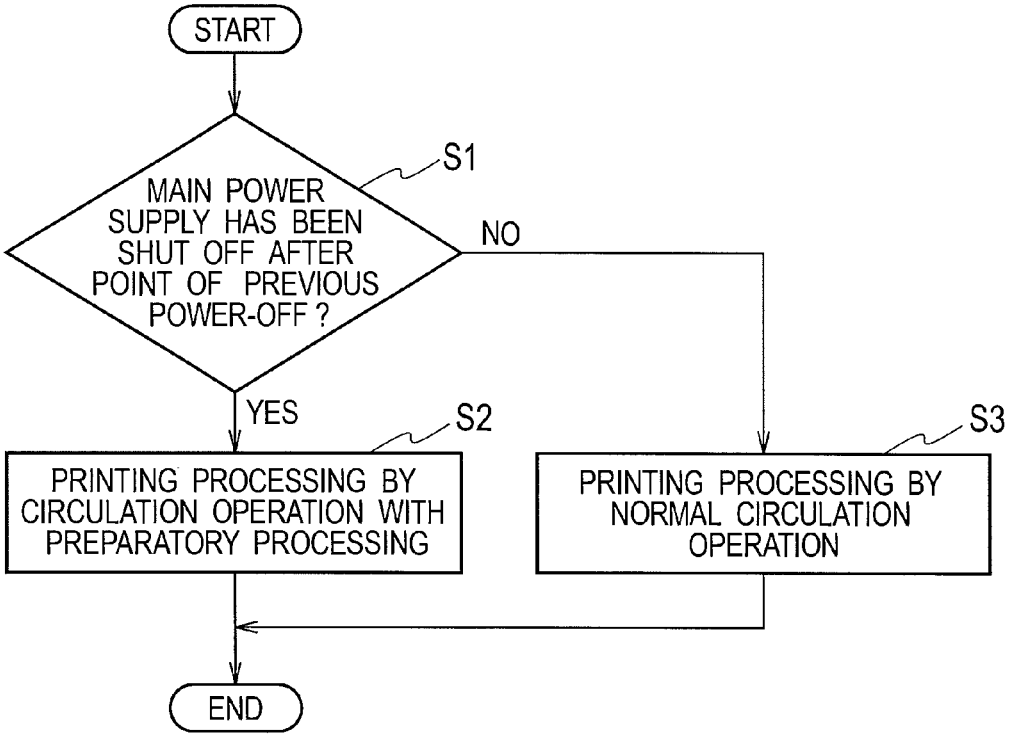
FIG. 5 is a flowchart for explaining an operation during printing of the inkjet printing apparatus illustrated in FIG. 1.

FIG. 5 is a flowchart for explaining the operation in printing of the inkjet printing apparatus 1. The processing in the flowchart in FIG. 5 is started when a print job inputted from the external interface 94 into the main controller 81 is divided into image data and job data by the CPU 91, and the job data is inputted into the mechanism controller 82. The job data includes information indicating the number of prints, sheet types and the like. When printing is to be performed, here, the inkjet printing apparatus 1 is in a state in which the power supply (sub power supply) is on.

At Step S1 in FIG. 5, the CPU 101 of the mechanism controller 82 determines whether or not the main power supply has been shut off after the power supply (sub power supply) is turned off the previous time. Here, if the latch is not held in the latch circuit 107 when the latch is read at the current power-on, the CPU 101 determines that the main power supply has been shut off after the previous power-off.

If it is determined that the main power supply has been shut off after the previous power off (Step S1: YES), at Step S2, the CPU 101 executes the printing processing by the circulation operation with preparatory processing.

If it is determined that the main power supply has not been shut off after the previous power off (Step S1: NO), at Step S3, the CPU 101 executes the printing processing by the normal circulation operation.

Figure 6:
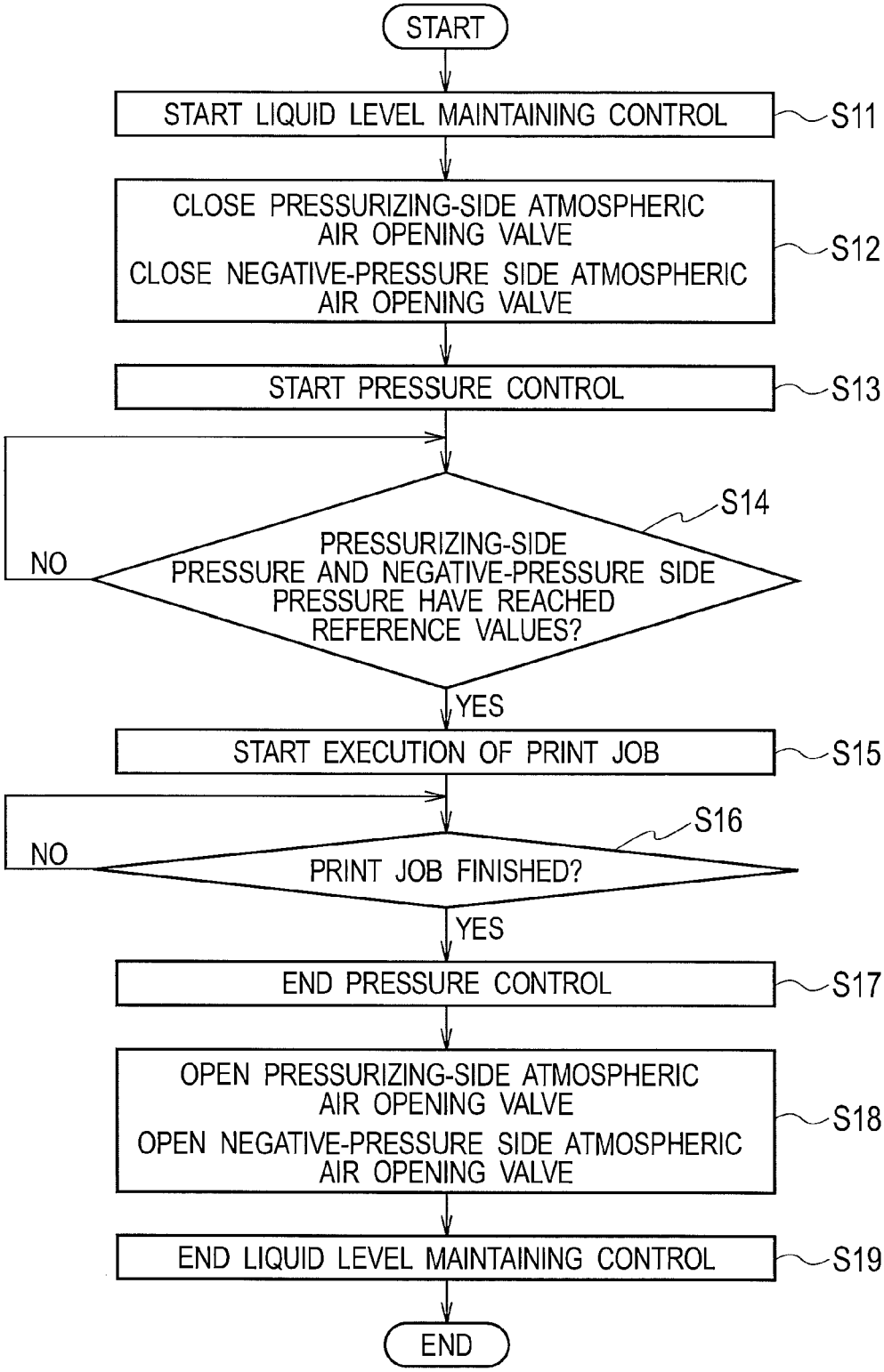
FIG. 6 is a flowchart of printing processing by a normal circulation operation.

Subsequently, the printing processing by the above-described normal circulation operation at Step S3 in FIG. 5 will be described. FIG. 6 is a flowchart of the printing processing by the normal circulation operation.

At Step S11 in FIG. 6, the CPU 101 of the mechanism controller 82 starts liquid level maintaining control. The liquid level maintaining control is control of the ink pump 25 and the ink supply valve 48 according to the liquid level heights of the pressurizing tank 21 and the negative-pressure tank 24 in order to maintain the liquid levels of the pressurizing tank 21 and the negative-pressure tank 24 in the vicinity of the reference height.

Specifically, as illustrated in FIG. 7, in a state in which both the pressurizing tank level sensor 32 and the negative-pressure tank level sensor 37 are on, the CPU 101 turns off the ink pump 25 and closes the ink supply valve 48. If the pressurizing tank level sensor 32 is on and the negative-pressure tank level sensor 37 is off, the CPU 101 similarly turns off the ink pump 25 and closes the ink supply valve 48.

If the pressurizing tank level sensor 32 is off and the negative-pressure tank level sensor 37 is on, the CPU 101 turns on the ink pump 25 and closes the ink supply valve 48.

If the pressurizing tank level sensor 32 and the negative-pressure tank level sensor 37 are both off, the CPU 101 turns off the ink pump 25 and opens the ink supply valve 48.

Returning to FIG. 6, subsequently to Step S11, at Step S12, the CPU 101 closes the pressurizing-side atmospheric air opening valve 53 and the negative-pressure side atmospheric air opening valve 57. By closing the pressurizing-side atmospheric air opening valve 53, the pressurizing tank 21 of each of the printing units 2 is brought into the sealed state through the pressurizing common air chamber 51. Moreover, by closing the negative-pressure side atmospheric air opening valve 57, the negative-pressure tank 24 of each of the printing units 2 is brought into the sealed state through the negative-pressure common air chamber 55. Here, the pressurizing-side pressure adjustment valve 52 and the negative-pressure side pressure adjustment valve 56 have been both closed since during standby.

Subsequently, at Step S13, the CPU 101 starts pressure control. The pressure control is control of the air pump 59, the pressurizing-side pressure adjustment valve 52, and the negative-pressure side pressure adjustment valve 56 for applying a positive pressure and a negative pressure of reference values, respectively to the pressurizing tank 21 and the negative-pressure tank 24 for maintaining them.

Specifically, when the CPU 101 starts the pressure control, it starts the air pump 59. As a result, air is fed from the negative-pressure common air chamber 55 to the pressurizing common air chamber 51, whereby the pressures of the negative-pressure common air chamber 55 and the negative-pressure tank 24 are reduced, and the pressures of the pressurizing common air chamber 51 and the pressurizing tank 21 are increased. As a result, the ink flows from the pressurizing tank 21 toward the inkjet head 11.

The CPU 101 stops the air pump 59 when each of a detected value of the pressurizing-side pressure sensor 54 (pressurizing-side pressure) and a detected value of the negative-pressure side pressure sensor 58 (negative-pressure side pressure) becomes a reference value of the pressurizing-side pressure and a reference value of the negative-pressure side pressure, respectively. The reference values of the pressurizing-side pressure and the negative-pressure side pressure are values set in advance as values for keeping a nozzle pressure of the inkjet head 11 within a proper range while ink is circulated. Here, the CPU 101 opens/closes the pressurizing-side pressure adjustment valve 52 and the negative-pressure side pressure adjustment valve 56 in accordance with the detected values of the pressurizing-side pressure sensor 54 and the negative-pressure side pressure sensor 58 so as to adjust the pressurizing-side pressure and the negative-pressure side pressure in order to keep the pressurizing-side pressure and the negative-pressure side pressure at the reference values.

After the start of the pressure control, even after the pressurizing-side pressure and the negative-pressure side pressure become the reference values once, the CPU 101 drives the air pump 59 and opens/closes the pressurizing-side pressure adjustment valve 52 and the negative-pressure side pressure adjustment valve 56 as appropriate in accordance with the detected values of the pressurizing-side pressure sensor 54 and the negative-pressure side pressure sensor 58 in order to maintain them.

After the start of the pressure control, at Step S14, the CPU 101 determines whether or not the pressurizing-side pressure and the negative-pressure side pressure have become the respective reference values. If it is determined that the pressurizing-side pressure and the negative-pressure side pressure have not become the respective reference values (Step S14: NO), the CPU 101 repeats Step S14.

If the CPU 101 determines that the pressurizing-side pressure and the negative-pressure side pressure have become the respective reference values (Step 14: YES), at Step S15, the CPUs 91 and 101 start execution of the print job. Specifically, the CPU 101 causes the transfer unit 4 to transfer a sheet on the basis of the job data. Moreover, the CPU 91 causes the inkjet head 11 to discharge the ink onto the transferred sheet on the basis of the image data. As a result, an image is printed on the sheet.

During execution of the print job, the ink is supplied from the pressurizing tank 21 to the inkjet head 11, and the ink not consumed in the inkjet head 11 is recovered into the negative-pressure tank 24. When the pressurizing tank level sensor 32 is turned off and the negative-pressure tank level sensor 37 is turned on by the liquid level maintaining control, the ink is fed by the ink pump 25 from the negative-pressure tank 24 to the pressurizing tank 21. In this way, the printing is performed while the ink is circulated.

Moreover, the CPU 101 adjusts an ink temperature by the ink temperature adjustment unit 26 so that a detected temperature of the ink temperature sensor 27 is kept within a proper temperature range during ink circulation.

After start of execution of the print job, at Step S16, the CPU 101 determines whether or not the print jab has been ended. If it is determined that the print job has not been ended (Step S16: NO), the CPU 101 repeats Step S16.

If it is determined that the print job has been ended (Step S16: YES), at Step S17, the CPU 101 ends the pressure control. Here, if the pressurizing-side pressure adjustment valve 52 and the negative-pressure side pressure adjustment valve 56 are open, the CPU 101 closes them.

Subsequently, at Step S18, the CPU 101 opens the pressurizing-side atmospheric air opening valve 53 and the negative-pressure side atmospheric air opening valve 57. By opening the pressurizing-side atmospheric air opening valve 53, the pressurizing common air chamber 51 and the pressurizing tank 21 of each of the printing units 2 are brought into the state open to the atmosphere. Moreover, by opening the negative-pressure side atmospheric air opening valve 57, the negative-pressure common air chamber 55 and the negative-pressure tank 24 of each of the printing units 2 are brought into the state open to the atmosphere.

Subsequently, at Step S19, the CPU 101 ends the liquid level maintaining control. As a result, the printing processing by the normal circulation operation is finished, and the inkjet printing apparatus 1 is brought into the standby state.

Subsequently, the printing processing by the above-described circulation operation with preparatory processing at Step S2 in FIG. 5 will be described.

As described above, the printing processing by the circulation operation with preparatory processing is executed if the main power supply has been shut off after the previous power-off. One of the reasons for the shut-off of the main power supply by the user is movement of the inkjet printing apparatus 1. That is, if the main power supply has been shut off, it is likely that the inkjet printing apparatus 1 has been moved.

If the inkjet printing apparatus 1 has been moved, meniscus of the nozzle of the inkjet head 11 might be broken by vibration during the movement. If the meniscus of the nozzle is broken, the inkjet head 11 suctions air through the nozzle. As a result, the ink inside the ink distributor 22 and the pipeline 28 flows down into the pressurizing tank 21, and the ink inside the inkjet head 11, the ink collector 23, and the pipeline 29 flows down into the negative-pressure tank 24. As a result, the pressurizing tank 21 and the negative-pressure tank 24 are fully filled with the ink.

If the above-described printing processing by the normal circulation operation is started in this state, the negative pressure is applied to the negative-pressure tank 24 in a full state, whereby the ink is suctioned and is likely to enter the pipeline 61 and the negative-pressure common air chamber 55.

The ink having entered the pipeline 61 and the negative-pressure common air chamber 55 might return to the negative-pressure tank 24. For example, if the ink is fed by the ink pump 25 from the negative-pressure tank 24 to the pressurizing tank 21 and the liquid level of the negative-pressure tank 24 lowers, the pressures in the negative-pressure tank 24 and the negative-pressure common air chamber 55 are reduced. As a result, the ink might flow into the negative-pressure tank 24 from the pipeline 61 and the negative-pressure common air chamber 55.

Here, since the negative-pressure common air chamber 55 is common to each of the printing units 2, if the ink in the negative-pressure common air chamber 55 flows into the negative-pressure tank 24 of the printing unit 2 corresponding to another color, the colors of the ink might be mixed. Moreover, the plurality of colors of the ink might be mixed in the negative-pressure common air chamber 55 and this ink in the mixed color might flow into the negative-pressure tank 24. If mixture of the colors of ink occurs as above, tones of a printed image is changed, and a print quality deteriorates.

If the ink enters the negative-pressure common air chamber 55, the ink enters the air pump 59 from there, which might cause the air pump 59 to break down.

Figure 8:
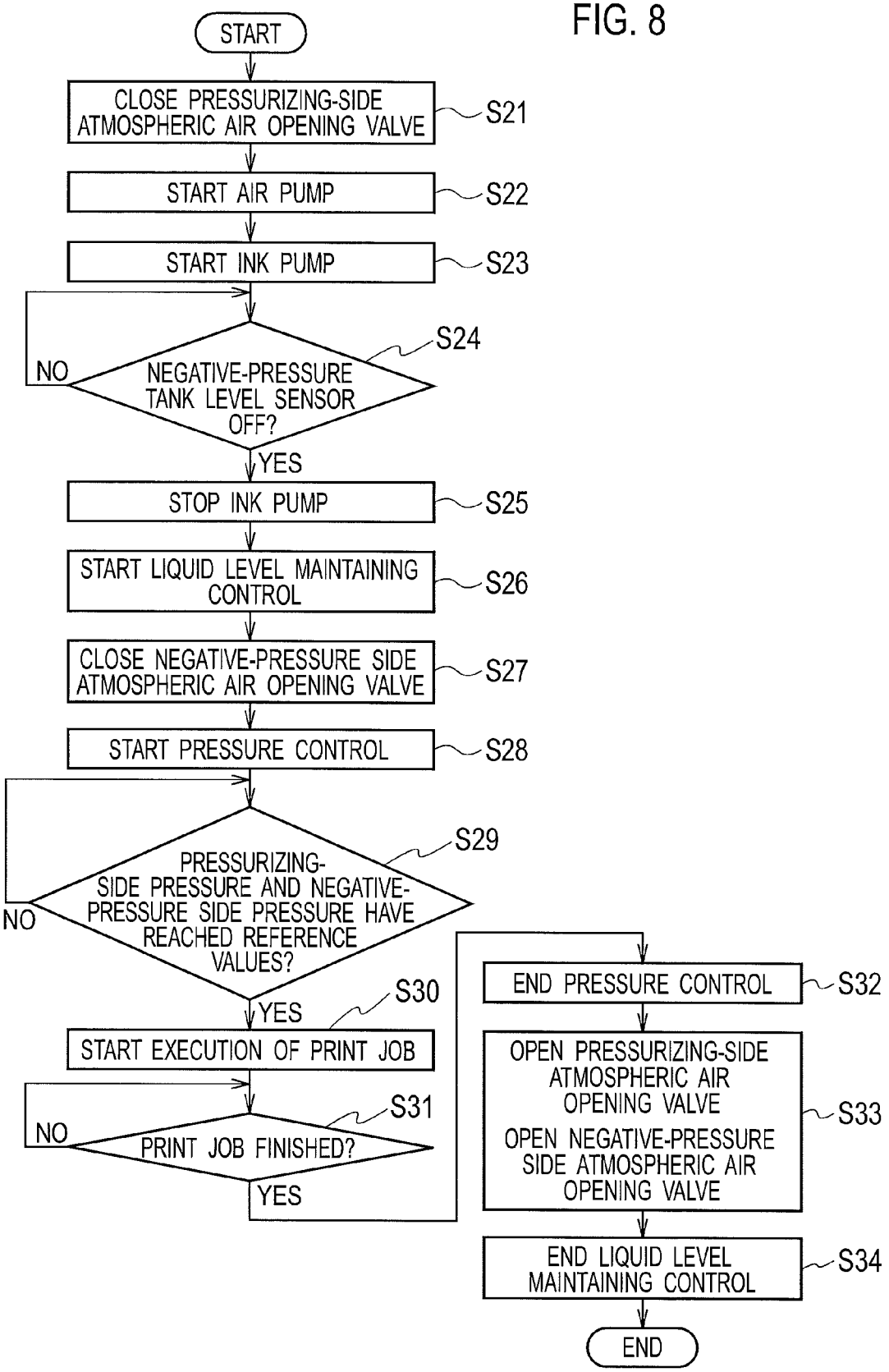
FIG. 8 is a flowchart of the printing processing by a circulation operation with preparatory processing.

The circulation operation with preparatory processing is to avoid suctioning of ink from the negative-pressure tank 24 and entry of the ink into the negative-pressure common air chamber 55 as described above. FIG. 8 is a flowchart of the printing processing by the circulation operation with preparatory processing. Here, it is assumed that the ink in the ink distributor 22 and the pipeline 28 has flowed down into the pressurizing tank 21, and the ink in the inkjet head 11, the ink collector 23, and the pipeline 29 has flowed down into the negative-pressure tank 24, whereby the pressurizing tank 21 and the negative-pressure tank 24 are in the full state. The inkjet head 11, the ink distributor 22, the ink collector 23, and the pipelines 28 and 29 are in a state of no ink.

At Step S21 in FIG. 8, the CPU 101 of the mechanism controller 82 closes the pressurizing-side atmospheric air opening valve 53. As a result, the pressurizing tank 21 of each of the printing units 2 is brought into the sealed state through the pressurizing common air chamber 51.

Here, the pressurizing-side pressure adjustment valve 52 and the negative-pressure side pressure adjustment valve 56 have been closed since during standby. The negative-pressure side atmospheric air opening valve 57 has been open since during standby. Therefore, the negative-pressure common air chamber 55 and the negative-pressure tank 24 of each of the printing units 2 are in the state open to the atmosphere.

Subsequently, the CPU 101 starts the air pump 59. As a result, the pressurizing common air chamber 51 and the pressurizing tank 21 of each of the printing units 2 are pressurized. As a result, the ink flows out of the pressurizing tank 21 through the pipeline 28, and the pipeline 28, the ink distributor 22, the inkjet head 11, the ink collector 23, and the pipeline 29 are sequentially filled with the ink.

Here, since the negative-pressure common air chamber 55 and the negative-pressure tank 24 are in the state open to the atmosphere, the negative pressure is not applied even if the air pump 59 is driven.

Subsequently, at Step S23, the CPU 101 starts the ink pump 25. As a result, the ink is fed from the negative-pressure tank 24 to the pressurizing tank 21, and the liquid level of the negative-pressure tank 24 is lowering. Here, since the positive pressure is applied to the pressurizing tank 21 and the ink is flowing out of the pressurizing tank 21 through the pipeline 28, the pressurizing tank 21 is not overflowed even if the ink flows into the pressurizing tank 21 from the negative-pressure tank 24.

Subsequently, at Step S24, the CPU 101 determines whether or not the negative-pressure tank level sensor 37 is off. If it is determined that the negative-pressure tank level sensor 37 is on (Step S24: NO), the CPU 101 repeats Step S24.

If it is determined that the negative-pressure tank level sensor 37 is off (Step S24: YES), the CPU 101 stops the ink pump 25 at Step S25. As a result, the liquid level in the negative-pressure tank 24 becomes less than the reference height.

Subsequently, at Step S26, the CPU 101 starts the above-described liquid level maintaining control.

Subsequently, at Step S27, the CPU 101 closes the negative-pressure side atmospheric air opening valve 57. As a result, the negative-pressure tank 24 of each of the printing units 2 is brought into the sealed state through the negative-pressure common air chamber 55. Here, the pressurizing-side atmospheric air opening valve 53 has been continuously in the closed state since it is closed at Step S21, and the pressurizing tank 21 of each of the printing units 2 is in the sealed state through the pressurizing common air chamber 51.

After that, the processing at Steps S28 to S34 is similar to the above-described processing at Steps S13 to S19 in FIG. 6. When the liquid level maintaining control is finished at Step S34, the printing processing by the circulation operation with preparatory processing is finished, and the inkjet printing apparatus 1 is brought into the standby state.

The above-described processing at Steps S21 to S25 in FIG. 8 corresponds to the preparatory processing. By means of this preparatory processing, the liquid level in the negative-pressure tank 24 is lowered to less than the reference height. After the preparatory processing, at Steps S26 to S34 in FIG. 8, the ink circulation similar to the normal circulation operation is performed. Since the liquid level in the negative-pressure tank 24 has been lowered by the preparatory processing to less than the reference height, even if the negative pressure is applied to the negative-pressure common air chamber 55 and the negative-pressure tank 24 during the ink circulation, suctioning of the ink from the negative-pressure tank 24 and entry of the ink into the negative-pressure common air chamber 55 are avoided.

Here, as described above, in the inkjet printing apparatus 1, if the main power supply has been shut off after the previous power-off, it is assumed that the inkjet printing apparatus 1 has been moved, and the ink of the inkjet head 11 or the like might flow down into the pressurizing tank 21 and the negative-pressure tank 24 by the vibration, and the printing processing by the circulation operation with preparatory processing is executed.

However, even if the main power supply has been shut off after the previous power-off, the inkjet printing apparatus 1 has not always been moved. Moreover, even if the inkjet printing apparatus 1 has been moved, the ink in the inkjet head 11 or the like does not always flow down into the pressurizing tank 21 and the negative-pressure tank 24.

Thus, in the inkjet printing apparatus 1, the printing processing by the circulation operation with preparatory processing might be executed in the normal standby state in which the ink in the inkjet head 11 or the like has not flowed down into the pressurizing tank 21 and the negative-pressure tank 24. In this case, the preparatory processing is not needed in the first place, but ink circulation is performed via the process of the preparatory processing.

As described above, in the inkjet printing apparatus 1, if the main power supply has been shut off after the previous power-off, the control unit 8 executes the printing processing by the circulation operation with preparatory processing. As a result, even if the negative-pressure tank 24 is full, the liquid level in the negative-pressure tank 24 is lowered by the preparatory processing, and suctioning of the ink from the negative-pressure tank 24 during the ink circulation and entry of the ink into the negative-pressure common air chamber 55 can be avoided.

That is, according to the inkjet printing apparatus 1, when the ink circulation is started, the liquid level of the negative-pressure tank is brought to less than the reference height by the preparatory processing and thus, deterioration of the print quality caused by mixture of colors of the ink can be suppressed. Moreover, entry of the ink into the air pump 59 can be reduced, whereby a failure of the air pump 59 can be reduced.

Moreover, in the inkjet printing apparatus 1, shut-off of the main power supply after the previous power-off is set as a preparatory processing execution condition; and if the preparatory processing execution condition is not satisfied, the printing processing by the normal circulation operation omitting the preparatory processing is executed. If the preparatory processing execution condition is not satisfied, the preparatory processing is omitted and thus, unnecessary preparatory processing is reduced, and delay in start of execution of the print job by the preparatory processing can be reduced.

A vibration sensor may be provided in the inkjet printing apparatus 1 so that detection by this vibration sensor of vibration in magnitude not less than a predetermined level may be set as the preparatory processing execution condition. As a result, necessity of the preparatory processing can be determined with high accuracy.

Moreover, a full-state detecting unit for detecting whether or not the negative-pressure tank 24 is full may be provided in the inkjet printing apparatus 1 so that detection of the full state of the negative-pressure tank 24 by this full-state detecting unit may be set as the preparatory processing execution condition. As a result, necessity of the preparatory processing can be determined with high accuracy. Here, as the full-state detecting unit, those similar to the float member 36 and the negative-pressure tank level sensor 37, for example, can be used.

Moreover, instruction of the circulation operation with preparatory processing through operation of the operation panel 5 by the user may be set as the preparatory processing execution condition. As a result, the preparatory processing can be executed on the basis of the determination of the user.

Moreover, the printing processing may be unconditionally executed by the circulation operation with preparatory processing without setting the preparatory processing execution condition.

Moreover, in the above-described embodiment, the configuration is described in which the pressurizing tank 21 of each of the printing units 2 communicates with the pressurizing common air chamber 51 through the pipeline 60 and the negative-pressure tank 24 of each of the printing units 2 communicates with the negative-pressure common air chamber 55, but it may be so configured that the four pipelines 60 and the four pipelines 61 merge into one pipeline, respectively. In this case, the air pump 59 is provided between the one pipeline to which the four pipelines 60 merge (corresponding to the pressurizing-side common space portion in claims) and the one pipeline to which the four pipelines 61 merge (corresponding to the negative-pressure side common space portion in claims). Moreover, an atmospheric air opening valve is provided on the one pipeline to which the four pipelines 60 merge and the one pipeline to which the four pipelines 61 merge, respectively.

Moreover, in the above-described embodiment, the inkjet printing apparatus 1 having the four printing units 2 is described, but the number of printing units 2 is not limited to that. The present invention can be applied even if the number of the printing units 2 is one.

In the case of the configuration with one printing unit 2, the pressurizing common air chamber 51 and the negative-pressure common air chamber 55 are not necessary. It is only necessary that the air pump 59 is connected to the pressurizing tank 21 and the negative-pressure tank 24 through a pipeline. However, even in the case of the configuration with one printing unit 2, an air chamber may be provided between the air pump 59 and the pressurizing tank 21 and between the air pump 59 and the negative-pressure tank 24, respectively, in order to suppress an influence of pulsation of the air pump 59. It is only necessary that the pressurizing-side atmospheric air opening valve 53 and the negative-pressure side atmospheric air opening valve 57 are directly provided on the pressurizing tank 21 and the negative-pressure tank 24, respectively.

In the case of the configuration with one printing unit 2, mixture of colors of ink does not occur but a failure of the air pump 59 can be reduced by executing the preparatory processing.

The present invention is not limited to the above-described embodiment as it is but can be embodied by varying the constituent element within a range not departing from the gist thereof in practice. Moreover, various inventions can be formed by appropriately combining the plurality of constituent elements disclosed in the above-described embodiment. For example, some constituent elements may be deleted from all the constituent elements illustrated in the embodiment.

The present application claims for priority based on Japanese Patent Application No. 2014-136741 filed on Jul. 2, 2014 and the entire content thereof is incorporated herein by reference.

According to the inkjet printing apparatus according to the present invention, when the ink circulation is started, the liquid level height of the negative-pressure tank is brought to less than the reference height by the preparatory processing and thus, the suctioning of the ink from the negative-pressure tank in ink circulation and entry of the ink into the air pump are reduced, and a failure of the air pump can be reduced. Moreover, suctioning of the ink from the negative-pressure tank and entry of the ink into the negative-pressure side common space portion during the ink circulation can be avoided, and deterioration of the print quality caused by mixture of colors of the ink can be suppressed.

REFERENCE SIGNS LIST

1 inkjet printing apparatus
2 printing unit
3 pressure adjustment unit
4 transfer unit
5 operation panel
6 power-supply nit
7 main power-supply switch
8 control unit
11 inkjet head

12 ink circulation unit
13 ink supply unit
21 pressurizing tank
22 ink distributor
23 ink collector
24 negative-pressure tank
25 ink pump
28 to 30, 60 to 67 pipeline
51 pressurizing common air chamber
53 pressurizing-side atmospheric air opening valve
55 negative-pressure common air chamber
57 negative-pressure side atmospheric air opening valve
59 air pump
81 main controller
82 mechanism controller

What is claimed is:

1. An inkjet printing apparatus comprising:

a printing unit having:

an inkjet head storing ink and discharging ink;

a pressurizing tank arranged below the inkjet head and storing ink to be supplied to the inkjet head;

a negative-pressure tank arranged below the inkjet head and receiving ink not consumed in the inkjet head;

a circulation path for circulating ink among the pressurizing tank, the inkjet head, and the negative-pressure tank; and an ink pump for feeding ink from the negative-pressure tank to the pressurizing tank;

a pressurizing-side atmospheric air opening valve for switching the pressurizing tank between a sealed state and an atmospheric air open state;

a negative-pressure side atmospheric air opening valve for switching the negative-pressure tank between a sealed state and an atmospheric air open state;

an air pump for feeding air from the negative-pressure tank to the pressurizing tank; and a control unit configured to bring the pressurizing tank and the negative-pressure tank into the sealed state, respectively, by the pressurizing-side atmospheric air opening valve and the negative-pressure side atmospheric air opening valve, to feed ink from the pressurizing tank toward the inkjet head by bringing about a state in which a positive pressure is applied to the pressurizing tank and a negative pressure is applied to the negative-pressure tank by the air pump, and to circulate ink along the circulation path by controlling driving of the ink pump in accordance with liquid level heights of the pressurizing tank and the negative-pressure tank, wherein the control unit, when starting ink circulation, executes preparatory processing of feeding ink from the pressurizing tank toward the inkjet head by applying a positive pressure to the pressurizing tank by the air pump in a state in which the pressurizing tank is sealed by the pressurizing-side atmospheric air opening valve and the negative-pressure tank is opened to the atmosphere by the negative-pressure side atmospheric air opening valve; and feeding ink from the negative-pressure tank to the pressurizing tank by the ink pump until the liquid level height of the negative-pressure tank reaches less than a reference height.

2. The inkjet printing apparatus according to claim 1, comprising:

a plurality of the printing units; further a pressurizing-side common space portion communicating with the pressurizing tanks of the plurality of printing units; and a negative-pressure side common space portion communicating with the negative-pressure tanks of the plurality of printing units, wherein:

the pressurizing-side atmospheric air opening valve switches the pressurizing tanks of the plurality of printing units between the sealed state and the atmospheric air open state through the pressurizing-side common space portion;

the negative-pressure side atmospheric air opening valve switches the negative-pressure tanks of the plurality of printing units between the sealed state and the atmospheric air open state through the negative-pressure side common space portion; and the air pump feeds air from the negative-pressure tanks to the pressurizing tanks of the plurality of printing units through the pressurizing-side common space portion and the negative-pressure side common space portion.

3. The inkjet printing apparatus according to claim 2, wherein the control unit executes the preparatory processing when a predetermined preparatory processing execution condition is satisfied and omits the preparatory processing when the preparatory processing execution condition is not satisfied.

4. The inkjet printing apparatus according to claim 1, wherein the control unit executes the preparatory processing when a predetermined preparatory processing execution condition is satisfied and omits the preparatory processing when the preparatory processing execution condition is not satisfied.

* * * * *